United States Patent [19]

Miki

[11] 4,104,089

[45] Aug. 1, 1978

[54] DIE-CAST ALUMINUM ALLOY PRODUCTS

[75] Inventor: Isao Miki, Shimizu, Japan

[73] Assignee: Nippon Light Metal Company Limited, Tokyo, Japan

[21] Appl. No.: 703,654

[22] Filed: Jul. 8, 1976

[51] Int. Cl.[2] ..... C22C 21/02

[52] U.S. Cl. ..... 148/32.5; 75/141; 75/142; 75/146; 75/147; 148/3; 148/159

[58] Field of Search ..... 75/147, 148, 146, 141, 75/142; 148/3, 159, 32, 32.5

[56] References Cited

U.S. PATENT DOCUMENTS

| | | | |
|---|---|---|---|
| 1,947,121 | 2/1934 | Bonsack | 75/148 |
| 3,128,176 | 4/1964 | Martin | 75/148 |

*Primary Examiner*—R. Dean

*Attorney, Agent, or Firm*—William J. Daniel

[57] ABSTRACT

Die-cast aluminum alloy products of excellent toughness and high strength are obtained from an alloy consisting essentially of 7 to 12% of Si, preferably 8 to 10% of Si, 0.2 to 0.5% of Mg, preferably 0.25 to 0.35% of Mg, 0.65 to 1.2% of Fe, preferably 0.7 to 1.0% of Fe and 0.55 to 1.0% of Mn, preferably 0.6 to 0.8% of Mn, the balance being Al and impurities. These products are produced by die-casting a molten aluminum alloy of this composition into any desired shape employing the known pore-free die-casting process with oxygen gas as the reactive gas and subjecting the cast product to solution heat treatment at a temperature ranging from 450° to 530° C, and then aging at a temperature ranging from 150° to 230° C, to thereby improve the toughness and high strength thereof.

3 Claims, No Drawings

DIE-CAST ALUMINUM ALLOY PRODUCTS

DETAILED DESCRIPTION OF THE INVENTION

The present invention relates to die-cast products of aluminum alloys of high strength and excellent toughness.

Die-casting is an excellent casting process which can mass produce castings of a complex shape efficiently and products having wide spread use as automobile parts, mechanical parts, electrical parts and the like have been cast in this manner.

As observed in A413, A360, A380 and 384 designated in A.A. (the Standard Casting Alloy of the American Association), most aluminum alloys for die-casting contain Si within the range from about 8 to 13% and Cu, Mg and the like in minor amounts. Die-cast products from such conventional alloys have a tensile strength ranging from 25 to 30 Kg/cm$^2$ and thus are relatively excellent in strength but have the disadvantages of a low elongation from 1 to 3% and a markedly low Charpy impact value from 0.1 to 2 Kg.m/cm$^2$.

Thus, there are often problems in the application of such alloys to parts susceptible to markedly high impact or to parts unfavorable to maintenance when subjected to the brittle fracture such as accessories of brakes, shock absorbers, wheel base and the like in automobiles.

It is an object of the present invention to provide die-cast products of aluminum alloys having excellent toughness and high strength compared to conventional die-casting aluminum products. The alloys of the present invention consists of 7 to 12% of Si, 0.2 to 0.5% Mg, 0.65 to 1.2% of Fe and from 0.55 to 1.0% of Mn, the balance being Al and impurities. According to an embodiment of the invention, a molten aluminum alloy of a controlled composition within said specified ranges is die-cast into any desired shape and then the die casting products are subjected to a suitable heat treatment to provide a tensile strength of about 30 Kg/mm$^2$, an elongation of higher than about 10% and a Charpy impact value of higher than 3 Kg.m/cm$^2$. These heat treated products have far better toughness than conventional die-casting aluminum products and are usable widely not only as safe-guard parts in vehicles but also as movable parts in machines and other parts susceptible to stress or impact.

The present invention will be now illustrated in specific embodiments. Table 1 is a comparison of the chemical compositions of aluminum alloys employed in the invention and somewhat similar known compositions according to AA.

Table 1.

| | Chemical compositions in % by weight | | | | | |
|---|---|---|---|---|---|---|
| | Cu | Si | Mg | Fe | Mn | Al |
| Alloys of the invention | — | 7–12 | 0.2–0.5 | 0.65–1.2 | 0.55–1.0 | Balance |
| | | (8–10) | (0.25–0.35) | (0.7–1.0) | (0.6–0.8) | (Balance) |
| A360 | ≦0.6 | 9.0–10.0 | 0.4–0.6 | ≦1.3 | ≦0.35 | Balance |
| A380 | 3.0–4.0 | 7.5–9.5 | ≦0.1 | ≦1.3 | ≦0.5 | Balance |

( ): designate the most preferable ranges of the present invention

The alloys according to the present invention are of the so-called "silumine type" aoluminum alloy containing Si as the essential alloying element and the content from 7 to 12% of Si is within the conventional composition range in such alloys of this type. The alloys containing Si within this range have excellent castability and can be die-cast easily into complex shapes including thin-walled portions.

Mg in a content from 0.2 to 0.5% in the present alloys enhances the strength of the resulting castings, in cooperation with the Si content, when given a suitable heat treatment. At a content of lower than 0.2%, such an effect is poor and at a content of higher than 0.5%, the toughness of the product is decreased markedly. The coexistence of Fe in a content from 0.65 to 1.2% and Mn in a content from 0.55 to 1.0% in the alloys improves the toughness of the resulting alloy products.

At an Fe content of lower than 0.65% or an Mn content of lower than 0.55%, the improvement of toughness of the products is insignificant and at an Fe content of higher than 1.2% or an Mn congent of higher than 1.0%, the toughness of the products is rather reduced.

Although the composition of the alloy according to the present invention is generally determined to be within the aforementioned ranges, the most preferable composition is determined within the ranges from 8 to 10% of Si, from 0.25 to 0.35% of Mg, from 0.7 to 1.0% of Fe and from 0.6 to 0.8% of Mn.

Allowable ranges of impurities of the alloy are less than 0.2% of Cu, less than 0.1% of Cr, less than 0.3% of Zn and less than 0.1% of Ti. When the impurities exceed the foregoing ranges, a decrease in toughness occurs.

In the present invention, for obtaining the coat products having sufficient toughness and increased strength from the alloy having the above mentioned composition there will require a rapid cooling of 20° C/sec. or more in the casting process and a proper heat treatment after the casting process. If the rapid cooling velocity in the casting process is less than 20° C/sec., any subsequent heat treatment will not produce a favorable result.

Accordingly in the present invention, the cast products are obtained by means of a known pore-fre die-casting process which develops less pores in the cast product. This pore-free die-casting process is detailed in U.S. Pat. No. 3,106,402 by Ladtke. The reason for adopting the pore-free die-casting process is that the die cast products according to the present invention can be imparted with the desired toughness and strength by subjecting them to suitable heat treatment after the die casting and the presence of pores in a great number would result in blisters and deformation of the treated products upon subsequent heat treatment.

The products according to the present invention can be provided with markedly high toughness by a solution heat treatment at a temperature ranging from 450°to 530° C. The products subjected to the solution heat treatment can be provided with even higher toughness by aging at a temperature from 150° to 230° C for a period of longer than 1 hour.

The present invention will be now illustrated by the following examples.

EXAMPLE 1

An aluminum alloy having a composition as shown in Table 2 was die cast by means of a pore-free die-casting process in which the air in the die cast machine had been replaced by oxygen gas to prepare 2,000 crank cases. The cast articles were then heated at 500° C for 2 hours, followed by hardening by means of water. The hardened articles were then aged at 190° C for 4 hours.

Table 3 shows data obtained by measuring the tensile strength, elongation and Charpy impact value on specimens sampled from the products obtained. For comparison, Table 3 shows also data obtained by measuring such properties on die cast articles of conventional A.A. alloys having a generally similar composition as shown on Lines (2) and (3) and treated under the same condition.

Table 2

| | Chemical composition | | | | | |
|---|---|---|---|---|---|---|
| | Cu | Si | Mg | Fe | Mn | Al |
| (1) Alloy according to the invention | — | 9 | 0.3 | 1.0 | 0.65 | Balance |
| (2) A360 | — | 9 | 0.5 | 1.0 | — | Balance |
| (3) A380 | 3.1 | 9 | — | 1.0 | — | Balance |

Table 3

| | Tensile strength ($Kg/mm^2$) | Elongation (%) | Impact value ($Kg.m/cm^2$) |
|---|---|---|---|
| (1) | 31.0 | 14 | 4.1 |
| (2) | 30.5 | 6 | 1.3 |
| (3) | 32.5 | 2 | 1.8 |

It has been found, as shown by the data of Table 3, that the die-cast products of the present invention have strength as high as that of conventional die-cast products and far higher elongation and impact value.

EXAMPLE 2

2,000 Hubs for autobicycles were die cast by means of a pore-free die-casting process with oxygen gas, using a molten aluminum alloy comprising 10% of Si, 0.3% of Mg, 0.6% of Mn and 1.0% of Fe, the balance being Al and impurities. Then the casting hubs were solution heat treated at 500° C for 5 hours. Sampled specimens thereof had the following tensile strength, elongation and Charpy impact value, thus has excellent strength and toughness.

| | |
|---|---|
| Tensile strength ($Kg/mm^2$) | 30.1 |
| Elongation (%) | 15.5 |
| Impact value ($Kg.m/cm^2$) | 4.3 |

What is claimed is:

1. Die-cast aluminum alloy products of high strength, toughness and impact strength and consisting essentially be weight of 7 to 12% of Si, 0.2 to 0.5% of Mg, 0.65 to 1.2% of Fe, 0.55 to 1.0% of Mn and the balance being Al and impurities, said products obtained by die-casting said aluminum alloy while molten into any desired shape by means of a pore-free die-casting process in which oxygen gas is the active gas, cooling the resultant die-castings at a cooling velocity of at least 20° C/sec and subjecting the resultant cooled die-castings to solution heat treatment at a temperature ranging from 450° to 530° C, followed by aging at a temperature ranging from 150 to 230° C.

2. Die-cast products as in claim 1 consisting essentially by weight of 8 to 10% of Si, 0.25 to 0.35% of Mg, 0.7 to 1.0% of Fe, 0.6 to 0.8% of Mn and the balance being Al and impurities.

3. An aluminum alloy as in claim 1 containing as impurities less than 0.2% of Cu, less than 0.1% of Cr, less than 0.3% of Zn, and less than 0.1% of Ti, all by weight.

* * * * *